US007976437B1

(12) United States Patent
von Detten

(10) Patent No.: US 7,976,437 B1
(45) Date of Patent: Jul. 12, 2011

(54) EXERCISE TREADMILL HAVING A SIMULATED COBBLESTONE RUNNING SURFACE

(76) Inventor: Volker von Detten, El Segundo, CA (US)

( * ) Notice: Subject to any disclaimer, the term of this patent is extended or adjusted under 35 U.S.C. 154(b) by 0 days.

(21) Appl. No.: 12/924,087

(22) Filed: Sep. 20, 2010

Related U.S. Application Data

(60) Provisional application No. 61/343,569, filed on Apr. 30, 2010.

(51) Int. Cl.
*A63B 22/02* (2006.01)

(52) U.S. Cl. ..... 482/54

(58) Field of Classification Search ..... 482/51, 482/54; 601/94, 119, 129, 132, 135
See application file for complete search history.

(56) References Cited

U.S. PATENT DOCUMENTS 662,083 A * 11/1900 McFadden ..... 482/126
1,700,633 A * 1/1929 Hendrickson ..... 601/132
2,154,831 A * 4/1939 Booharin ..... 601/143
4,334,676 A * 6/1982 Schonenberger ..... 482/54
4,635,927 A * 1/1987 Shu ..... 482/7
4,635,928 A * 1/1987 Ogden et al. ..... 482/54
4,659,074 A * 4/1987 Taitel et al. ..... 482/54
4,892,090 A * 1/1990 Kaeser ..... 601/99
4,925,183 A * 5/1990 Kim ..... 482/61
5,096,188 A * 3/1992 Shen ..... 482/51
5,186,703 A * 2/1993 Huang ..... 482/148
5,279,528 A * 1/1994 Dalebout et al. ..... 482/54
5,352,166 A * 10/1994 Chang ..... 482/52
5,490,821 A * 2/1996 Wu ..... 601/134
5,527,241 A * 6/1996 Peng ..... 482/54
5,676,638 A * 10/1997 Shefi ..... 601/124
5,868,689 A * 2/1999 Faroky et al. ..... 601/120
6,709,365 B2 * 3/2004 Zeilinger ..... 482/35
6,918,859 B1 * 7/2005 Yeh ..... 482/54
7,013,588 B2 * 3/2006 Chang ..... 36/141
D571,917 S * 6/2008 Stoši ..... D24/171
7,510,511 B2 * 3/2009 von Detten ..... 482/54
7,731,632 B2 * 6/2010 Wu ..... 482/37

* cited by examiner

*Primary Examiner* — Steve R Crow
(74) *Attorney, Agent, or Firm* — Gene Scott, Patent Law & Venture Group

(57) ABSTRACT

A running surface for a common exercise treadmill has an endless belt made of a rubber like material leaving a smooth finish to its upper and lower surfaces. At least one line of spaced apart holes penetrate the belt along its entire length. The holes enable fastening elements to affix generally circular rods to the upper surface to engage fastening eyelets by means of the fastening elements which are installed into at least one strengthening endless belt positioned below and urging against the lower extremity of the endless belt. The generally circular rods have prefabricated objects such as simulated cobblestones of various sizes and configurations in immediate adjacency to the upper extremity of the endless belt.

15 Claims, 10 Drawing Sheets

EXERCISE TREADMILL HAVING A SIMULATED COBBLESTONE RUNNING SURFACE

RELATED APPLICATIONS

This application claims the priority date of a prior filed application having Ser. No. 61/343,569 and filing date of Apr. 30, 2010 and entitled: Exercise Treadmill Having a Simulated Cobblestone Running Surface.

INCORPORATION BY REFERENCE

Applicant(s) herein incorporate by reference, any and all U.S. patents and U.S. patent applications cited or referred to in this application.

BACKGROUND OF THE INVENTION

1. Field of the Invention

This invention relates generally to exercising equipment and more particular to a treadmill for performing walking, jogging and running having an endless running surface with a particular surface condition.

2. Background

Exercising treadmills are very common and readily available in various configurations. They are used for performing aerobics, walking, running and the like with the user remaining in a relative stationary position during the exercise. Other treadmills are used for therapy and diagnostic purposes such as cardiovascular stress testing. For all these purposes a user of an exercise treadmill normally performs an exercise routine at a relatively steady and continuous level of physical activity. Exercising treadmills normally have an endless running surface, which is extended between and movable around a pair of substantially parallel pulleys at each end of the treadmill. A running surface may comprise an endless belt of a rubber like material of a given thickness. An endless belt is normally driven by a motorized arrangement having a pulley encircled by an endless chain loop engaging a pinion gear mounted to the axle of a motor shaft engaging a drive sprocket mounted to the axle shaft of a pulley to allow an endless belt to travel in a forward direction. The endless belt of a rubber like material is sturdy with high tensile strength strong enough to withstand continuous pounding and pulling by a user walking or jogging on the endless belt. The endless belt is typically supported along at least its length and width between said pulleys by one of several well-known designs in order to enable the endless belt to support the weight of a user. For example, rollers may be positioned below the endless belt or a web in horizontal plane may be placed contiguous with under side of the endless belt, and in particular a smooth panel made of wood or metal may be used in order to provide the required support. Depending on the general application, the endless belt may be of a homogeneous material or in another application may have a top layer laminated to a bottom layer: the latter consisting of a rubber like material having interwoven nylon fabric or steel wire mesh for strengthening and reinforcement. It is known that many similar configurations of endless belts are common and easily obtained and have been proven to be of particular ruggedness and strength as well as being suitable for conveyor belts used for industrial applications, and therefore have particular suitability for exercising treadmills. The running surface of an endless belt is typically of a smooth and non-textured finish exclusively designed for the convenience of a user in a way to simulate running surfaces such as asphalt or professional track and field type terrain. It is known and has been established that simulation of the running surface to a natural occurring terrain such as non-smoothened natural ground, pebbles and cobble stones are considered to be of great benefit to a user resulting in improved balance control, cardiovascular fitness and weight control. It is now known that walking and running on a cobblestone surface can be of up to 50 percent more beneficial in terms of health benefits to a user than just walking and running on smooth artificial surfaces. Therefore a running surface constructed for a common treadmill to include a cobblestone texture may be considered of great benefit to a user.

DESCRIPTION OF RELATED ART

The following art defines the present state of this field. Examples of treadmills for exercising purposes are described in U.S. Pat. Nos. 7,510,511, 5,279,528, 4,659,074, 4,635,928, 4,635,927, 4,334,676, and 7,510,511.

U.S. Pat. No. 7,510,511 to von Detten describes a treadmill running surface comprising an endless belt having simulated cobblestones attached thereto and the endless belt extends movably between and around a pair of substantial parallel pulleys at each end of the treadmill belt. U.S. Pat. No. 7,510,511 teaches an attachment method for simulated cobblestones that necessitate a belt of a sufficient thickness to provide for proper retention of the cobblestones. The endless belt for a common treadmill is many times thinner in cross section and therefore is very pliable and flexible which is necessary to circumvent smaller diameter pulleys. As a consequence a thicker belt is more rigid and certainly requires larger diameter pulleys, and in addition makes the treadmill larger and bulkier and requires an electric motor of greater power to move the belt around the pulleys. This gives rise to disadvantages that are obvious and easily recognized, including the fact that a thicker belt is more costly to manufacture, a more powerful electric motor consumes more electricity and a larger and bulkier treadmill is more costly to manufacture and is unsightly. Further disadvantages are the need for a multiple number of through holes penetrating the belt for the attachment of cobblestones whereby once said cobblestones are fixated to the belt there is beside the cost to produce all the through holes which produces an added degree of rigidity to the belt caused by the array and density of eyelets needed for the fastening apparatus of the cobblestones. Furthermore, the method of attachment makes it very labor intensive and cumbersome exchanging the cobblestones in various sizes and patterns in an arrangement using the same belt that necessitates complete disassembly of the treadmill among other requirements. At best there is a very limited number of feasible patterns and arrangements of cobblestones assemblies.

SUMMARY OF INVENTION

The present invention teaches certain benefits in construction and use, which give rise to the objectives described below.

An endless belt for a common exercise treadmill is made of a rubber like material leaving a smooth finish to upper and lower extremity over the entire length and width thereof. At least one line of through holes evenly spaced apart penetrates the endless belt along the entire length thereof. The through holes are enabling for receiving a plurality of fastening elements to affix a plurality of generally cylindrical rods to the upper extremity of the endless belt with the fastening elements engaging with fastening eyelets thereof installed into at least one strengthening endless belt thereof urging against the lower extremity of the endless belt. Prefabricated objects such as simulated cobblestones of various sizes are disposed onto the cylindrical rods and are configured to be in immediate adjacency to the upper extremity of the endless belt.

A primary objective of one embodiment of the present invention is to provide an apparatus and method of use of such apparatus that yields advantages not taught by the prior art.

A still further objective of the invention is to provide a means to closely simulate a natural cobblestone terrain.

Another objective of the invention is that it is capable of being used with common treadmill designs of various sizes and configurations necessitating only minor modifications thereof.

A still further objective is to assure that the invention has various sizes and arrays of simulated cobblestones can be used with an endless belt.

A still further objective of the invention is that the endless belt has simulated cobblestones that are easily adaptable to any given treadmill configuration for retrofit.

A still further objective of the invention is that it is capable of being used with treadmills having a pully of relatively small circumference.

A yet still further objective is of the invention is that the endless belt has simulated cobblestones that are not easily deformed and strained when traversing pullies.

A further objective of the invention is that it has the ability to readily change a preferred configuration to another preferred configuration without great effort and in a timely manner.

A still further objective of the invention is that it provides the ability to readily change a preferred configuration to another preferred configuration without disassembly of any treadmill components.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

Figure 1:
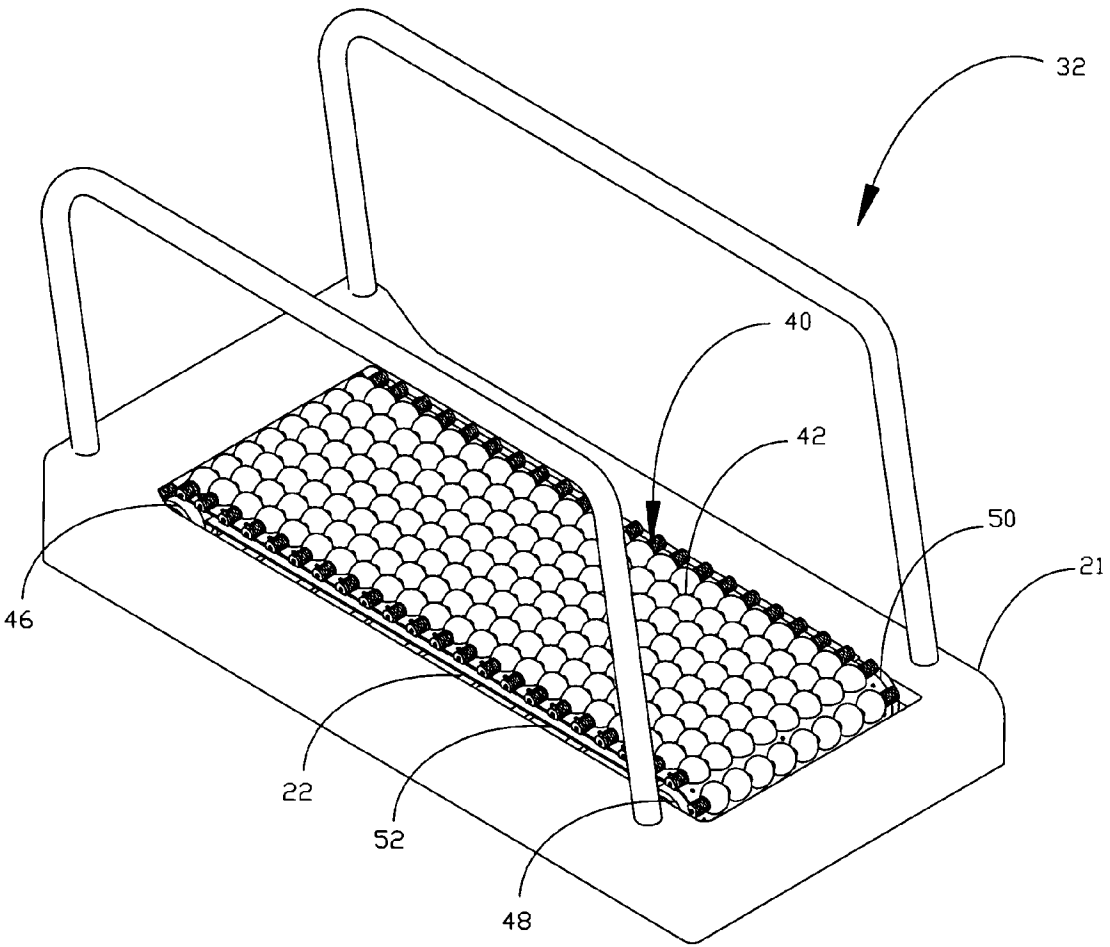
FIG. 1 is a perspective view of a preferred embodiment of the present invention showing a common treadmill equipped with an endless running surface tread having simulated cobblestones attached thereto.

FIG. 1 is an isometric view of an embodiment of the present invention. A Treadmill 32 has an endless running surface 40 with a plurality of simulated cobblestones 42 attached to an endless belt 50. A base 21 supports a motorized gear actuator (not shown). Between opposing side brackets (not shown) is mounted drive pulley 46 and idler pulley 48 respectively each rotationally fitted about a center axle (not shown). A support panel 52 is a member of structural integrity rigidly fastened to a plurality of cross members 22 providing support to the underside of the endless belt 40 in contiguous fashion thereto. There are many treadmills of varying configurations readily available in commerce where the aforementioned specification is meant to be of a general nature but specific enough to convey the understanding that the endless running surface 40, as conceived by this invention can easily be installed with most readily available treadmill configurations.

Figure 2:
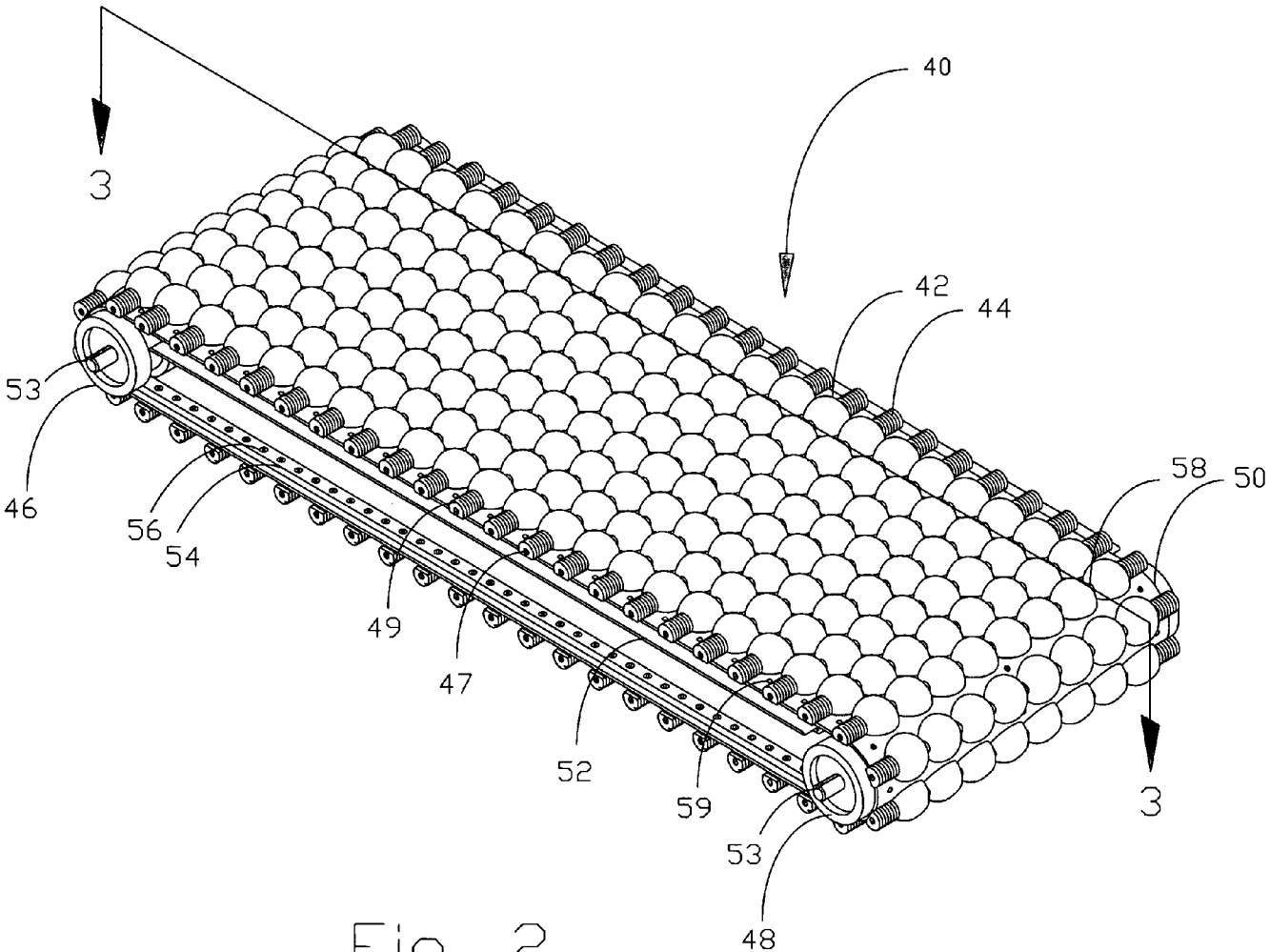
FIG. 2 is a perspective view of a preferred embodiment of the present invention showing the endless running surface tread having uniformly shaped and simulated cobblestones attached to an upper extremity thereof.

FIG. 2 is an isometric view of an embodiment of the invention. The endless running surface 40 is shown to be separated from treadmill 32—refer to FIG. 1. The endless belt 50 partially encircles drive pulley 46 and idler pulley 48 respectively thereof is rotationally fitted about a pair of center axles 53. At least one line of a plurality of equally spaced apart through holes 59 are positioned along the entire length of endless belt 50 and are able to receive a plurality of mounting rods 58 fastened thereto by means of a plurality of fasteners—not shown—engaging with a plurality of fastening eyelets 56. Fastening eyelets 56 are fitted with a plurality of endless strengthening belts 54 configured immediately adjacent to the underside of endless belt 50 in a contiguous fashion.

Furthermore the fastening eyelets 56 are equally spaced apart in coaxial alignment with through holes 59 along the entire length of endless strengthening belts 54. It is noteworthy to mention the configuration of the strengthening belt provides for proper tracking of the running surface enabling a positive and rigid containment of objects such as the mounting rods or other related objects on the endless belt without compromising the integrity of the endless belt so that a standard configured belt, commonly used on any treadmill can be applied to an endless running surface as specified in this present invention. The simulated cobblestones 42 are engaged with mounting rods 58 and are retained with a plurality of spacers 44 and a pair of retainer caps 49 respectively thereof each fastened to each end of mounting rod 58 by means of a fastener 47. Support panel 52 is immediately adjacent to the lower extremity of endless belt 50 to provide structural support in contiguous fashion thereto. Support panel 52 is supported and fastened to cross members 22 as shown in FIG. 1.

Figure 3:
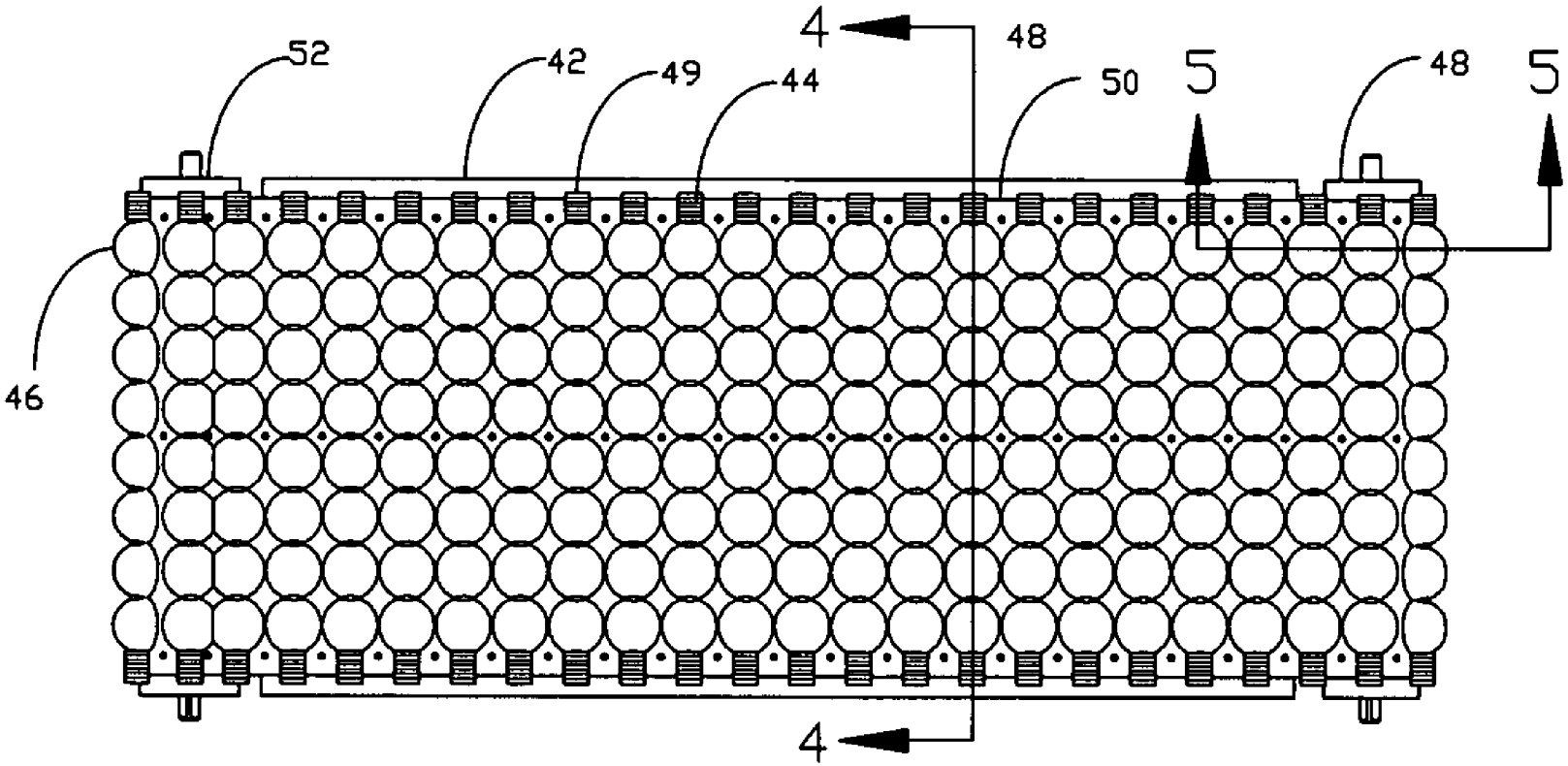
FIG. 3 is a plan view of a preferred embodiment of the present invention taken along lines 3-3 respectively in FIG. 2.

FIG. 3 is a top down view of an embodiment of the present invention. The endless running surface 40 is shown to be separated from treadmill 32 as shown in FIG. 1. All elements as labeled are referenced in FIG. 2.

Figure 4:
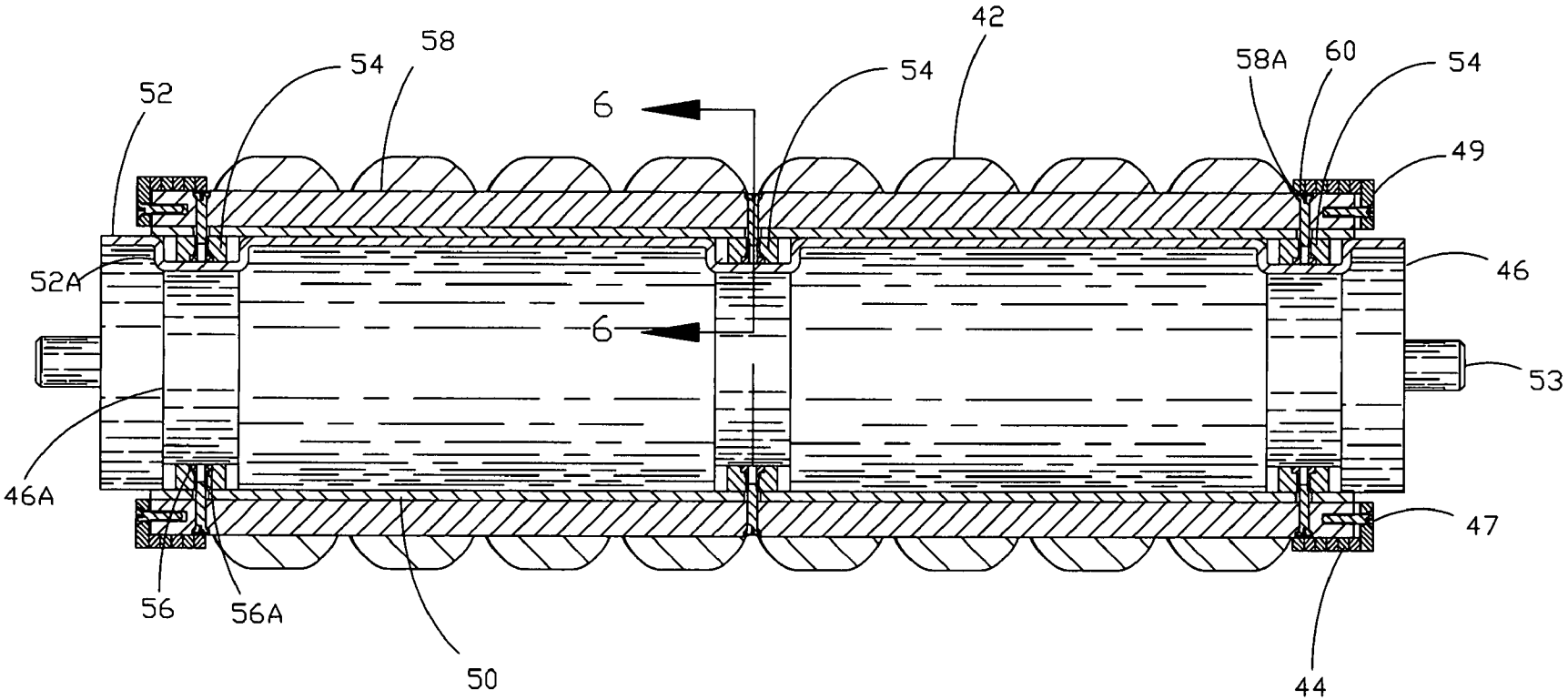
FIG. 4 is a cross sectional front elevation view of a preferred embodiment of the present invention taken along lines 4-4 respectively in FIG. 3.

FIG. 4 is a cross section view of an embodiment of the present invention. Endless belt 50 partially encircles drive pulley 46 whereas mounting rods 58 are fitted to the upper extremity of endless belt 50 via a plurality of fasteners 60, each disposed to and surrounded by a countersink hole 58A provided in mounting rods 58. The opposite end of fasteners 60 are engaged with fastening eyelets 56 and permanently surrounded by counter bore holes 56A provided in endless strengthening belts 54, as referenced in FIG. 2, thereby urging the upper extremity thereof against the lower extremity of endless belt 50 and respectively the lower extremity of mounting rods 58 against the upper extremity of endless belt 50 thereby sandwiching endless belt 50 between endless strengthening belts 54 and mounting rods 58. Simulated cobblestones 42 are engaged with the mounting rods 58 and being laterally retained by means of spacers 44 and retainer cap 49 thereof fastened to each end of mounting rod 58 by means of fastener 47. Support panel 52 is immediately adjacent to the lower extremity of endless belt 50 to provide structural support in a contiguous fashion thereto. Support panel 52 is supported and fastened to a plurality of cross members 22 as is referenced in FIG. 1. Support panel 52 has a plurality of channels 52A configured for accommodation of endless strengthening belts 54 as such to provide immediate adjacency with support panel 52 and the lower extremity of endless strengthening belts 54 thereby to assure immediate adjacency with the upper extremity of channel 52A in a contiguous fashion. It is noteworthy to mention that the sliding motion of the endless belt over the support panel during operation of the treadmill is smooth and unimpaired by the contiguous lateral support of the support panel which specifically includes the lower extremity of endless strengthening belts 54. A plurality of grooves 46A fully surrounding pulleys 46 and 48 (not shown) are compliant with the outer contour of endless strengthening belts 54.

Figure 5:
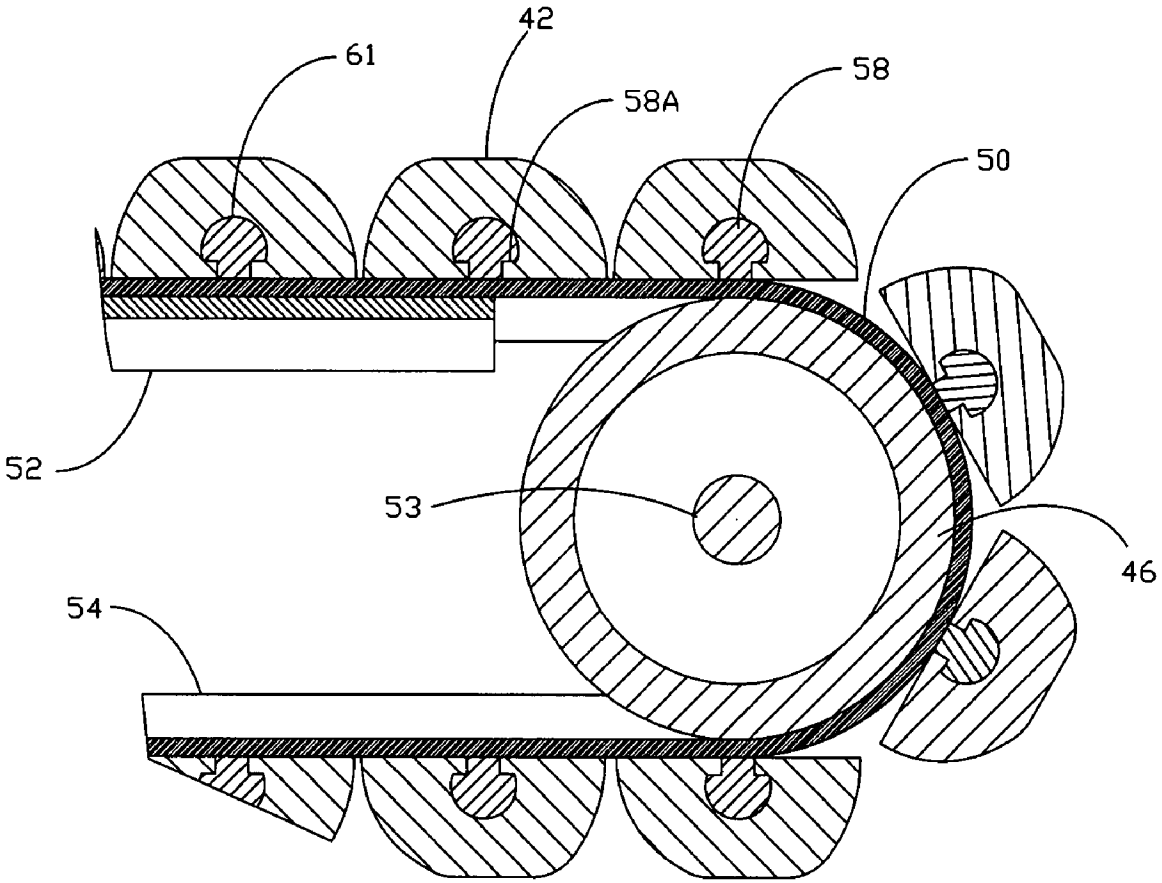
FIG. 5 is a cross sectional breakaway feature view of a preferred embodiment of the present invention taken along lines 5-5 respectively in FIG. 3.

FIG. 5 is a cross section breakaway view of an embodiment of the present invention. The endless belt 50 and the endless strengthening belts 54 partially encircle the drive pulley 46 thereof rotationally fitted about center axle 53. The lower extremity of mounting rods 58 comprise a horizontal surface without slope, tilt or curvature respectively, and include a ledge 58A elevated from and parallel to the horizontal surface. The lower extremity of mounting rods 58 is immediately adjacent to the upper extremity of endless belt 50. Simulated cobblestones 42 are disposed to mounting rods 58, each having a through keyway 61 surrounding the outer shape of the mounting rod 58 and in immediate adjacency thereto. Furthermore, key way 61 is configured as such that the lower extremity of simulated cobblestone 42 is in immediate adjacency with the upper extremity of endless belt 50. As is easily recognized, the aforesaid arrangement warrants a method for securely retaining simulated cobblestones 42 for negotiating the return loop around drive pulley 46 without impairing the structural integrity of endless belt 50 including endless strengthening belts 54. Most notably the method for securing mounting rods 58 to endless belt 50 and endless strengthening belts 54, respectively referring to FIG. 4, and the method of engagement for simulated cobblestones 42 with mounting rods 58 as described above enables the lower extremity of endless belt 50 and endless strengthening belts 54 respectively to be contiguous with the outer extremity of drive pulley 46 and support panel 52 respectively, thereby providing proper traction of endless belt 50 during operation of the treadmill. It is noteworthy to mention that the aforesaid arrangement guarantees non-impairment of natural pliability of endless belt 50 having mounting rods 58 and simulated cobblestones 42 and endless strengthening belts 54 respectively when circumventing drive pulley 46, and provides as a further advantage adaptability to pulleys of smaller circumference as may be found on certain types of common treadmills. This is of significant consequence as to the universal application of this invention to a wide array of types and readily available treadmill endless belts in commerce.

Figure 6:
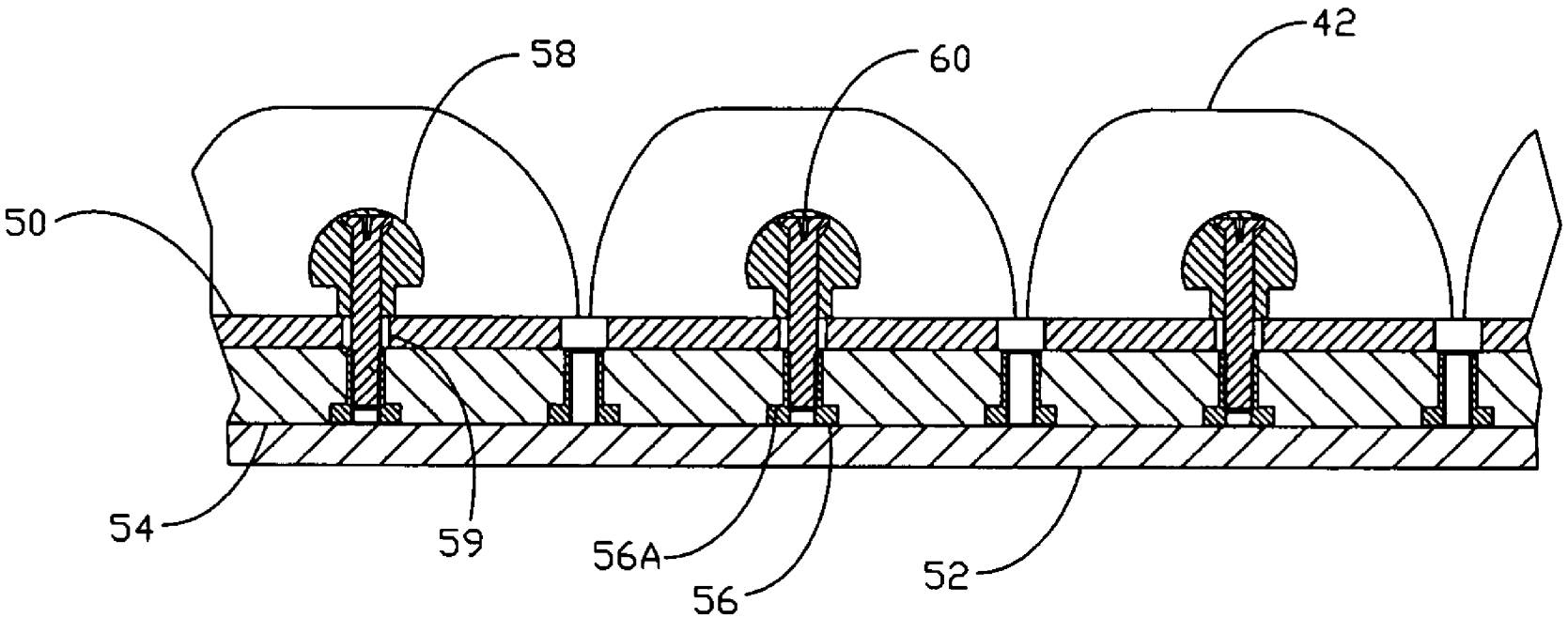
FIG. 6 is a cross sectional breakaway feature view of a preferred embodiment of the present invention taken along lines 6-6 respectively in FIG. 4.

FIG. 6 is a cross section breakaway view of an embodiment of the present invention. Fastening eyelets 56 are disposed in counterbored holes 56A provided to endless strengthening belts 54. It is noteworthy to mention that the counterbore portion of hole 56A is slightly greater in depth than the length of the shoulder for fastening eyelet 56 to assure that the underside of endless strengthening belt 54 is flush and unimpaired throughout the entire length and width thereof. Furthermore, the shoulder of each fastening eyelet 56 urges against the land of each counterbore 56A thereby forcing the upper extremity of endless strengthening belt 54 to urge against the lower extremity of endless belt 50 by means of each fastener 60 thereof disposed to each mounting rod 58 and fastened to each eyelet 56. The lower extremity of mounting rods 58 comprise a horizontal surface without slope, tilt or curvature respectively thereby urging the upper extremity of endless belt 50 in a contiguous fashion along the entire length and width of mounting rod 58. All elements as labeled otherwise are referenced in FIG. 4. It is noteworthy to mention that the alternate holes and eyelets as shown are available for installing the mounting bars variably spaced apart thereby enhancing the flexibility of this invention providing various walking patterns tailored to the users need. Specifically, smaller or larger cobblestones at various distances from each other can be installed quickly and inexpensive without changing the running surface, which enables the use of a standard endless belt used on common treadmills.

Figure 7:
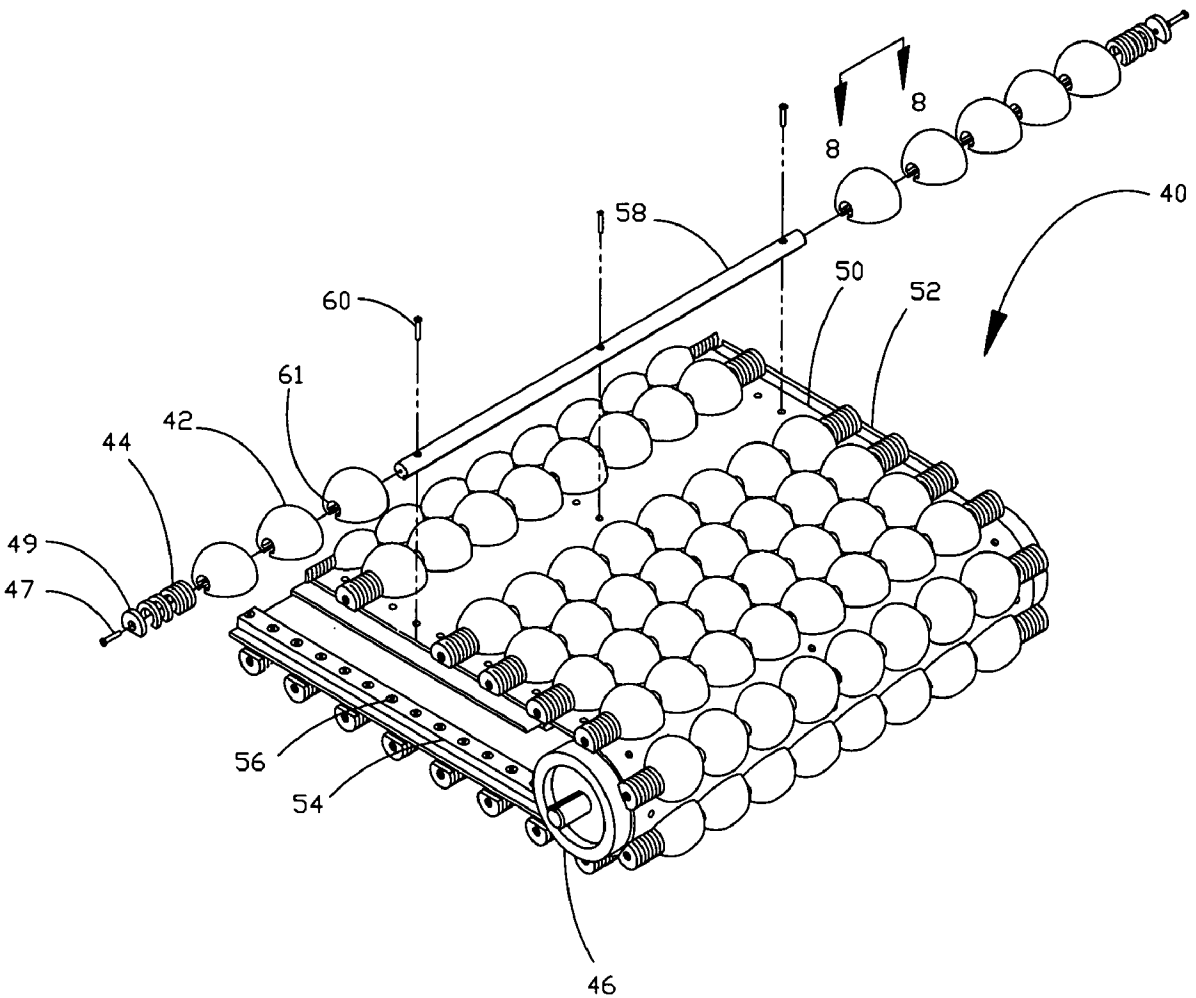
FIG. 7 is a perspective break away feature and partial exploded view of a preferred embodiment of the present invention showing the endless running surface tread as referenced in FIG. 2.

FIG. 7 is an isometric break away and partially exploded view of an embodiment of the present invention. It is noteworthy to mention that the exploded view demonstrates the ease of assembling simulated cobblestones 42 onto the mounting rods 58 and retaining them in stationary positions by means of the spacers 44 and retainer caps 49 with fasteners 47 respectively. Furthermore, it is easily recognizable that the aforesaid method demonstrates a quick and efficient method of reinstalling simulated cobblestones of various sizes and shapes as is referenced in FIG. 10. Alternatively compression springs (not shown) can be applied in place of the spacers for proper retention of various sized simulated cobblestones. All elements as labeled otherwise are referenced in FIG. 4 and FIG. 2

Figure 8:
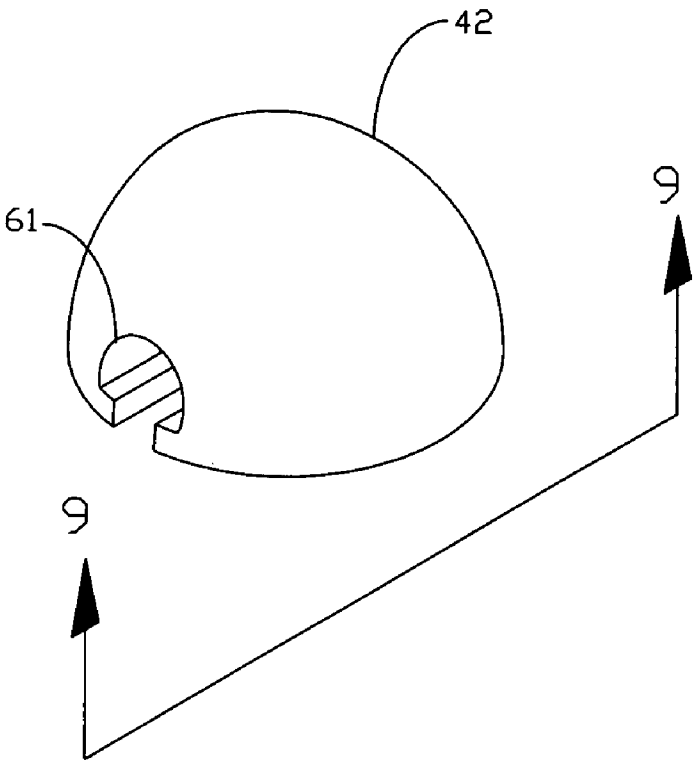
FIG. 8 is a further perspective view of a preferred embodiment of the present invention taken along lines 8-8 respectively in FIG. 7.

FIG. 8 is an isometric top down view of an embodiment of the present invention. The upper portion of simulated cobblestone 42 generally comprises a rounded and convex configuration whereas the lower extremity thereof comprises a horizontal surface without slope, tilt or curvature respectively. Keyway 61 there through along the horizontal plane is configured to be compliant and in immediate adjacency to the outer contour of mounting rod 58 as referenced in FIG. 5. It is of specific value to mention that keyway 61 and the outer contour of mounting rod 58 (not shown)—respectively have ledges as shown in FIG. 5—to provide a positive retention of the simulated cobblestone once mounted as well as to provide an easy and quick method for exchanging the cobblestone for other cobblestones as deemed necessary.

Figure 9:
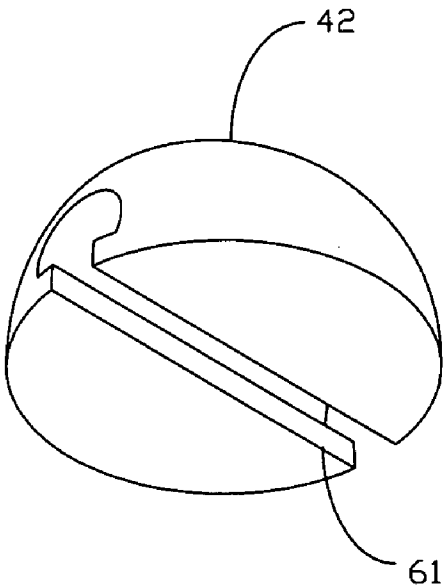
FIG. 9 is another perspective view of a preferred embodiment of the present invention taken along lines 9-9 respectively in FIG. 8.

FIG. 9 is an isometric bottom up view of an embodiment of the present invention. All elements as labeled otherwise are referenced in FIG. 8.

Figure 10:
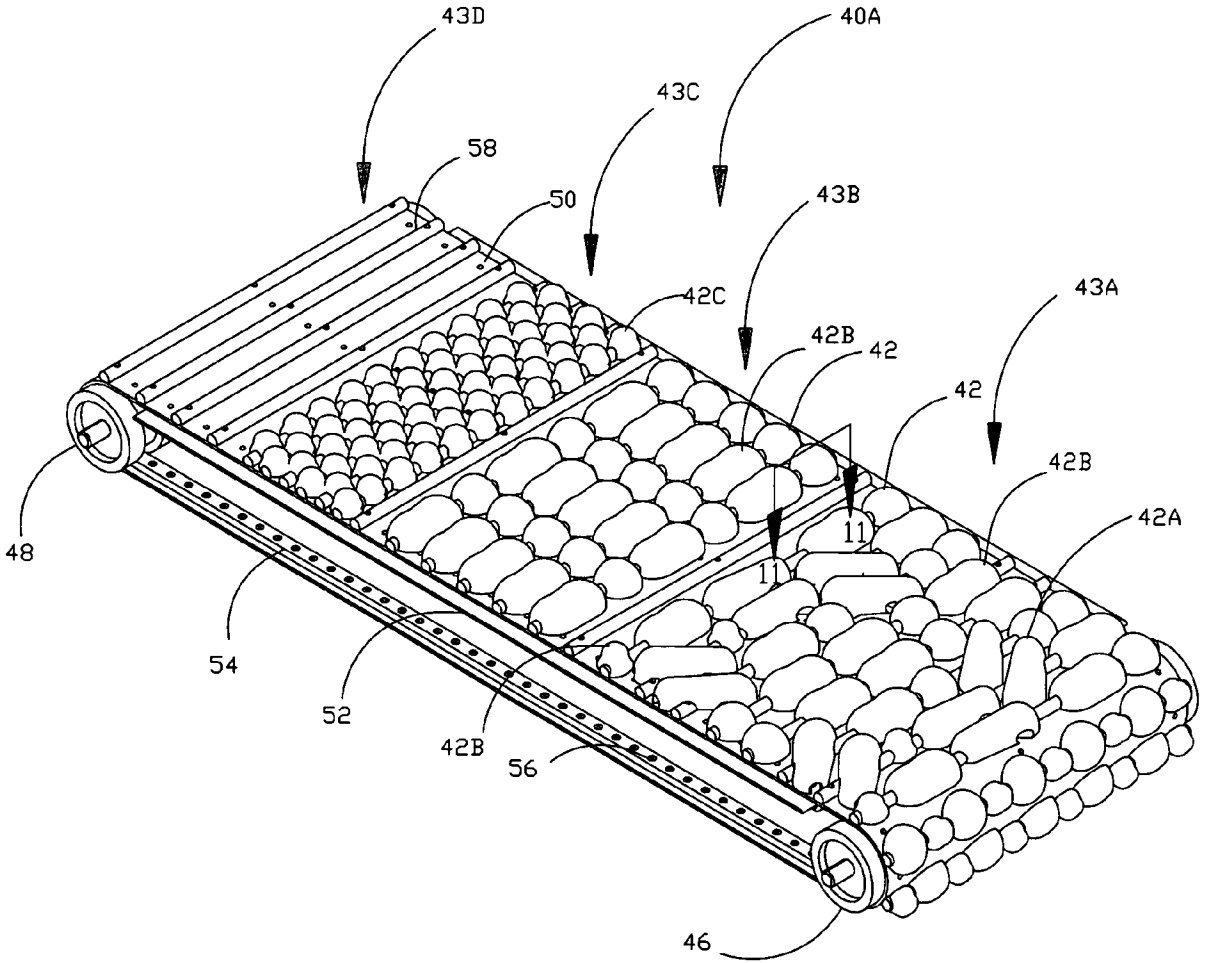
FIG. 10 is a further perspective view of a preferred embodiment of the present invention showing an endless running surface tread having non-uniformly shaped simulated cobblestones attached to an upper extremity thereof.

FIG. 10 is an isometric view of an embodiment of the present invention. The endless running surface 40A is of identical configuration to the endless running surface 40 as referenced in FIG. 1 and FIG. 2 with the exception to the shape, size and configuration of the plurality of simulated cobblestones 42, 42B and 42C respectively. These are example arrangements of various simulated cobblestone sizes and configurations divided into sections 43A, 43B and 43C and separated by mounting rods 58 shown without simulated cobblestones. That means specifically that any of aforesaid sections among many other arrangements, not shown, can be installed onto the endless running surface 40 as referenced in FIG. 1 and FIG. 2. Section 43A shows a combination of a plurality of simulated cobblestones 42, 42A and 42B respectively disposed to mounting rods 58. Section 43B shows a combination of simulated cobble stones 42 and 42A and section 42C shows exclusively simulated cobble stones 42B disposed to mounting rods 58 respectively and furthermore having mounting rods 58 more densely spaced. For further clarification section 43D shows the mounting rods 58 without cobblestones. Retainer caps 49, spacers 44 and fasteners 47, as referenced in FIG. 4, have been omitted. All elements as labeled otherwise are referenced in FIG. 2.

Figure 11:
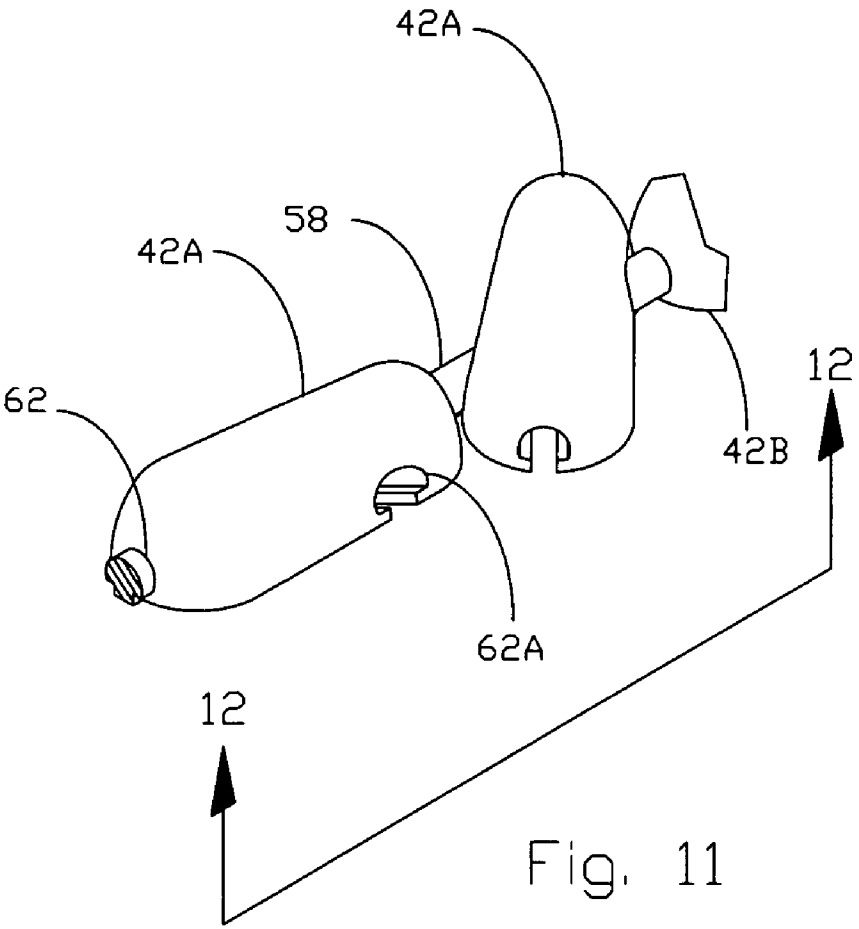
FIG. 11 is a perspective breakaway view of a preferred embodiment of the present invention taken along lines 11-11 respectively in FIG. 10.

FIG. 11 is a further isometric top down and break-away view of an embodiment of the present invention. A pair of simulated cobblestones 42A are engaged with mounting rod 58 via a keyway 62 and 62A respectively showing the pair of simulated cobblestones 42A in alternating orientation from each other along the horizontal plane.

Figure 12:
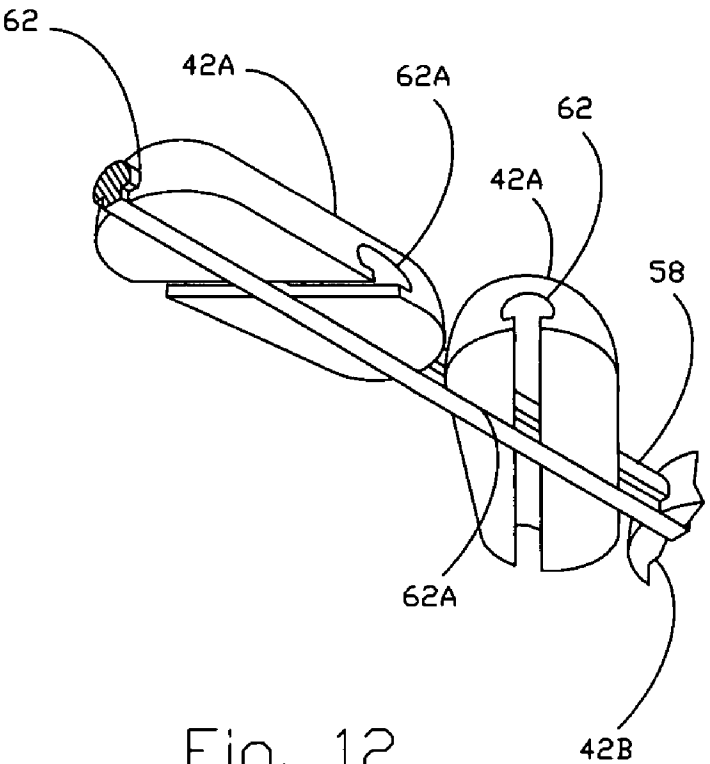
FIG. 12 is a further perspective breakaway view of a preferred embodiment of the present invention taken along lines 12-12 respectively in FIG. 11.

FIG. 12 is an isometric bottom up and break-away view of an embodiment of the present invention. Easily recognized are simulated cobblestones 42A with keyway 62 axially intersecting with keyway 62A in angular orientation to each other thereby enhancing the variability in patterns and combinations of the cobblestones beyond mounting bar spacing and simulated cobblestone size as is referenced in FIG. 10. All elements as labeled otherwise are referenced in FIG. 11.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element.

The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An endless running surface tread apparatus for a treadmill comprising:

an endless belt extending between and partially encircling a pair of pulleys, the pulleys mounted on a pair of center axles;

a plurality of endless strengthening belts having a plurality of counter bored through holes the strengthening belts positioned immediately adjacent to an underside of said endless belt;

a plurality of fastening eyelets secured to said endless strengthening belts;

a plurality of mounting rods secured to an upper extremity of said endless belt;

a plurality of simulated cobblestones disposed on said mounting rods;

a plurality of spacers disposed at each end of said mounting rods;

a retainer cap secured at each end of said mounting rods; and a support panel positioned immediately below the upper extremity of said endless belt and a lower extremity of said endless strengthening belts.

2. The apparatus of claim 1 wherein said endless belt has at least one longitudinal line of equally spaced-apart mounting holes therein.

3. The apparatus of claim 2 wherein the counter-bored through holes in the strengthening belts are in coaxial alignment with said mounting holes of said endless belt.

4. The apparatus of claim 1 wherein each said fastening eyelet has a shouldered cylindrical body with a threaded hole therethrough.

5. The apparatus of claim 1 wherein each said fastening eyelet is surrounded by said counterbored through holes with an upper extremity of said eyelet positioned below an upper extremity of said endless strengthening belt and a lower extremity of said eyelet positioned elevated above the lower extremity of said endless strengthening belt.

6. The apparatus of claim 1 wherein said mounting rods have a cylindrical elongated body having a lower extremity, a horizontal surface without a slope, tilt or curvature and a ledge elevated above and parallel to said horizontal surface.

7. The apparatus of claim 1 wherein each said mounting rods has a counter sunk hole in coaxial alignment with a fastening eyelet and a mounting hole.

8. The apparatus of claim 7 wherein the fastening of each said mounting rod to the upper extremity of said endless belt includes a fastener disposed to and surrounded by said counter sunk holes and said fastener is threaded into said fastening eyelet, thereby sandwiching said endless belt between the upper extremity of said endless strengthening belt and the lower extremity of said mounting rod.

9. The apparatus of claim 1 wherein said simulated cobblestones comprise an upper surface with a generally convex curvature and a lower horizontal surface.

10. The apparatus of claim 9 wherein each of said simulated cobblestones has a channel forming a first keyway within the horizontal surface, the keyway compliant with an outer contour of said mounting rod.

11. The apparatus of claim 10 further having a second keyway intersecting axially with said first keyway, whereby said second keyway is compliant with an outer contour of said mounting rod.

12. The apparatus of claim 11 wherein each of said cobblestones is mated within one of the first keyways and second keyways.

13. The apparatus of claim 1 wherein each of said cobblestones are secured by said spacers and said retainer caps, the retainer caps fastened to each end of said mounting rod by a fastener.

14. The apparatus of claim 1 wherein said support panel has a plurality of longitudinal channel like depressions adjacent to an outer contour of said endless strengthening belts.

15. The apparatus of claim 1 wherein each of said pulleys has a plurality of grooves concurrent with an outer contour of said endless strengthening belts.

* * * * *